US008806985B2

(12) United States Patent
Chen

(10) Patent No.: US 8,806,985 B2
(45) Date of Patent: Aug. 19, 2014

(54) REVERSING DEVICE FOR A RATCHET WRENCH

(76) Inventor: Bo-Shen Chen, Taichung County (TW)

( * ) Notice: Subject to any disclaimer, the term of this patent is extended or adjusted under 35 U.S.C. 154(b) by 220 days.

(21) Appl. No.: 13/487,458

(22) Filed: Jun. 4, 2012

(65) Prior Publication Data

US 2013/0319184 A1 Dec. 5, 2013

(51) Int. Cl.
*B25B 13/46* (2006.01)

(52) U.S. Cl.
CPC ..... *B25B 13/463* (2013.01)
USPC ..... 81/62

(58) Field of Classification Search
CPC .. B25B 13/463; B25B 13/465; B25B 13/466; B25B 13/461; B25B 23/0035
USPC ..... 81/60–63.2
See application file for complete search history.

(56) References Cited

U.S. PATENT DOCUMENTS

| | | | | |
|---|---|---|---|---|
| 3,290,969 | A * | 12/1966 | Bergquist et al. | 81/63.1 |
| 5,012,705 | A * | 5/1991 | Chow | 81/63 |
| 6,053,077 | A * | 4/2000 | Huang | 81/63.1 |
| 7,353,734 | B1 * | 4/2008 | Hu | 81/62 |
| 8,490,521 | B2 * | 7/2013 | Huang | 81/63.1 |

* cited by examiner

*Primary Examiner* — Hadi Shakeri
(74) *Attorney, Agent, or Firm* — Banger Shia

(57) ABSTRACT

A reversing device for a ratchet wrench comprises a body of the ratchet wrench, a ratchet wheel, a left engaging member, a right engaging member, a left spring, a right spring, a control member, and a control cover. Both of the left and right engaging members, when subjected to a force, will not be in contact with the control member, so that, the problem that the left or right engaging member, when subjected to a force, will push the control member to reversely rotate and cause slippage, can be solved.

6 Claims, 10 Drawing Sheets

REVERSING DEVICE FOR A RATCHET WRENCH

BACKGROUND OF THE INVENTION

1. Field of the Invention

The present invention relates to a ratchet wrench, and more particularly to a reversing device for a ratchet wrench.

2. Description of the Prior Art

Referring to FIGS. 1 and 2, a conventional ratchet wrench comprises a ratchet wheel 12, two engaging members 13, 14, two springs 15 and a control member 16 which are disposed in a head portion 111 of a body 11 of the ratchet wrench. On the head portion 111 is disposed a turning member 17 for turning the control member 16. The ratchet wheel 12 is provided with an engaging head 121 for engaging with a socket 18.

When the ratchet wrench needs to apply a torque only in a counterclockwise direction, the user can turn the turning member 17 to rotate the control member 16 in counterclockwise direction, as shown in FIG. 2, so that the control member 16 pushes the right engaging member 13 to make it disengage from the ratchet wheel 12 and make the left engaging member 14 engage with the ratchet wheel 12. By such arrangements, the ratchet wheel 12 is only able to idly rotate in the clockwise direction, namely, the ratchet wrench is only able to apply a unidirectional torque.

It is to be noted that the strength of the torque of the ratchet wrench partially depends on the engagement of the ratchet wheel, the engaging members and the control member. The normal problem is that the engaging members, when subjected to a force, will reversely push the control member to move, causing slippage between the engaging members and the ratchet wheel. The reason for slippage is because both of the two engaging members are in contact with the control member.

The present invention has arisen to mitigate and/or obviate the afore-described disadvantages.

SUMMARY OF THE INVENTION

The primary object of the present invention is to provide a reversing device for a ratchet wrench, wherein both of the left and right engaging members, when subjected to a force, are not in contact with the control member, so that, the slippage problem can be solved.

To achieve the above object, a reversing device for a ratchet wrench, comprises a body of the ratchet wrench, a ratchet wheel, a left engaging member, a right engaging member, a left spring, a right spring, a control member, and a control cover. The body of the ratchet wrench includes a handle portion, a head portion connected to the handle portion, a receiving cavity formed in the head portion, a left groove, a right groove, a left pivot groove, a right pivot groove which are formed on an inner surface of the receiving cavity, and a hole formed in the bottom of the receiving cavity. The ratchet wheel is pivotally disposed in the head portion and includes a work portion, a first pivot portion inserted in the hole, a ratchet portion connected to the first pivot portion and pivotally disposed in the receiving cavity, and a second pivot portion connected to the ratchet portion. The left engaging member is pivotally disposed in the head portion and includes a left pivot portion pivotally disposed in the left pivot groove, a left toothed portion selectively engaged with the ratchet portion, a left abutting surface formed between the left pivot portion and the left toothed portion and located toward the ratchet portion, and a left push surface formed between the left pivot portion and the left toothed portion and located toward the left groove. The right engaging member is pivotally disposed in the head portion and includes a right pivot portion pivotally disposed in the right pivot groove, a right toothed portion selectively engaged with the ratchet portion, a right abutting surface formed between the right pivot portion and the right toothed portion and located toward the ratchet portion, and a right push surface formed between the right pivot portion and the right toothed portion and located toward the right groove. The left spring is disposed between the left engaging member and the left groove and including a first left end to be abutted against the left groove, and a second left end which is pushed against the left push surface to push the left toothed portion to move toward the ratchet portion. The right spring is disposed between the right engaging member and the right groove and includes a first right end to be abutted against the right groove, and a second right end which is pushed against the right push surface to push the right toothed portion to move toward the ratchet portion. The control member is pivotally disposed in the head portion and includes a first pivot hole for insertion of the second pivot portion of the ratchet wheel, a left protrusion selectively pushed against the left abutting surface of the left engaging member, a left concave portion for accommodation of the left pivot portion of the left engaging member, a right protrusion selectively pushed against the right abutting surface of the right engaging member, a right concave portion for accommodation of the right pivot portion of the right engaging member. The control cover is pivotally disposed in the head portion to cover the receiving cavity and includes a second pivot hole for insertion of the second pivot portion, and an inserting portion inserted in the control member to push the control member to rotate. When the control cover turns the control member to a first position, the left and right protrusions of the control member are pushed against the left and right abutting surfaces of the left and right engaging members to make the left and right toothed portions of the left and right engaging members disengage from the ratchet portion of the ratchet wheel; when the control cover turns the control member to a second position, the left protrusion of the control member is pushed against the left abutting surface of the left engaging member to make the left toothed portion disengage from the ratchet portion of the ratchet wheel, the right protrusion of the control member is not pushed against the right abutting surface of the right engaging member to make the right toothed portion of the right engaging member engage with the ratchet portion of the ratchet wheel; when the control cover turns the control member to a third position, where the right protrusion of the control member is pushed against the right abutting surface of the right engaging member to make the right toothed portion disengage from the ratchet portion of the ratchet wheel, and the left protrusion of the control member is not pushed against the left abutting surface of the left engaging member to make the left toothed portion of the left engaging member engage with the ratchet portion of the ratchet wheel.

Preferably, the work portion is a columnar structure connected to the first pivot portion and exposed out of the receiving cavity.

Preferably, the work portion is a cavity formed in the first pivot portion and the ratchet portion.

Preferably, the control member is formed with an inserting hole for insertion of the inserting portion of the control cover.

Preferably, the control cover includes a control protrusion to be turned by a user.

Preferably, a first groove, a second groove, and a third groove are formed on the inner surface of the receiving cavity of the body, and in the inserting portion of the control cover are disposed a compression spring, and a ball which is pressed against the compression spring and partially exposed out of the inserting portion, when the control cover rotates the control member to the first, second and third positions, the ball will be engaged in the first, second and third grooves, respectively.

DETAILED DESCRIPTION OF THE PREFERRED EMBODIMENTS

The present invention will be clearer from the following description when viewed together with the accompanying drawings, which show, for purpose of illustrations only, the preferred embodiment in accordance with the present invention.

Figure 1:
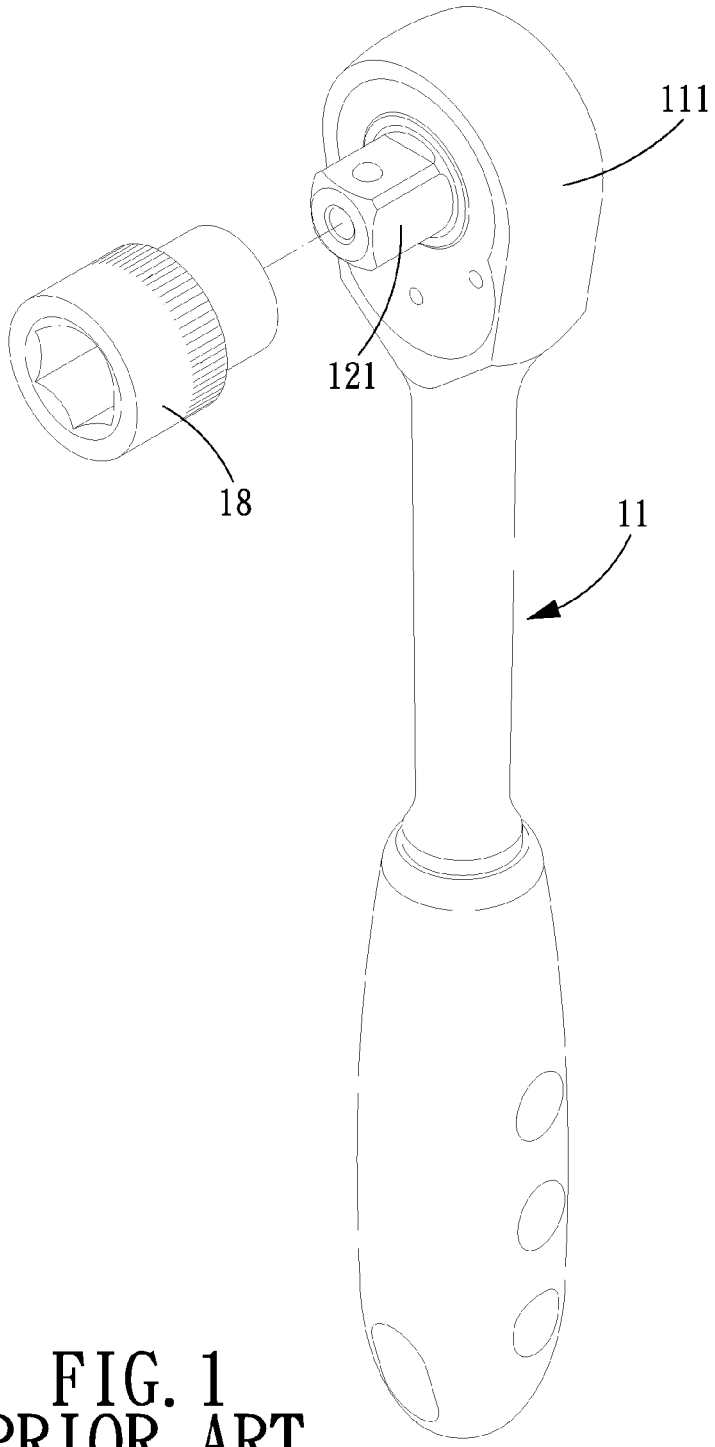
FIG. 1 PRIOR ART
FIG. 1 is a perspective view of a conventional ratchet wrench.
Figure 2:
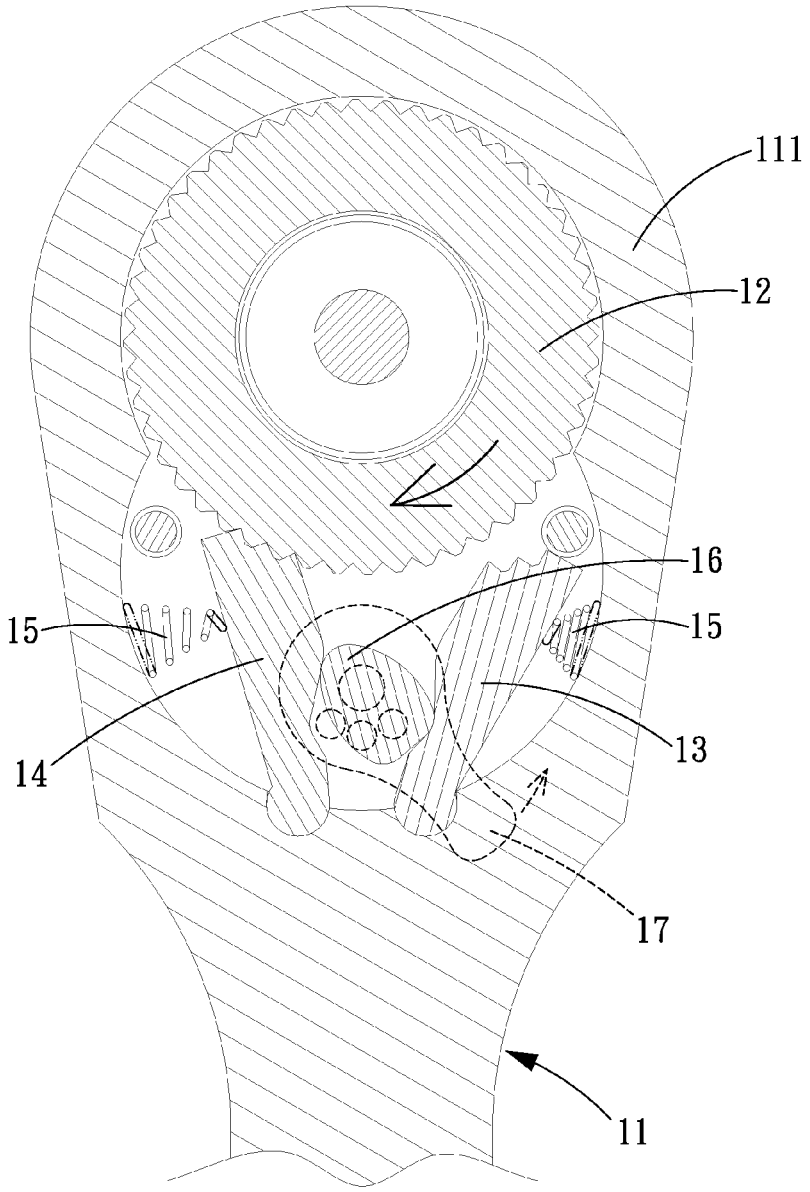
FIG. 2 PRIOR ART
FIG. 2 is a cross sectional view of the conventional ratchet wrench.
Figure 3:
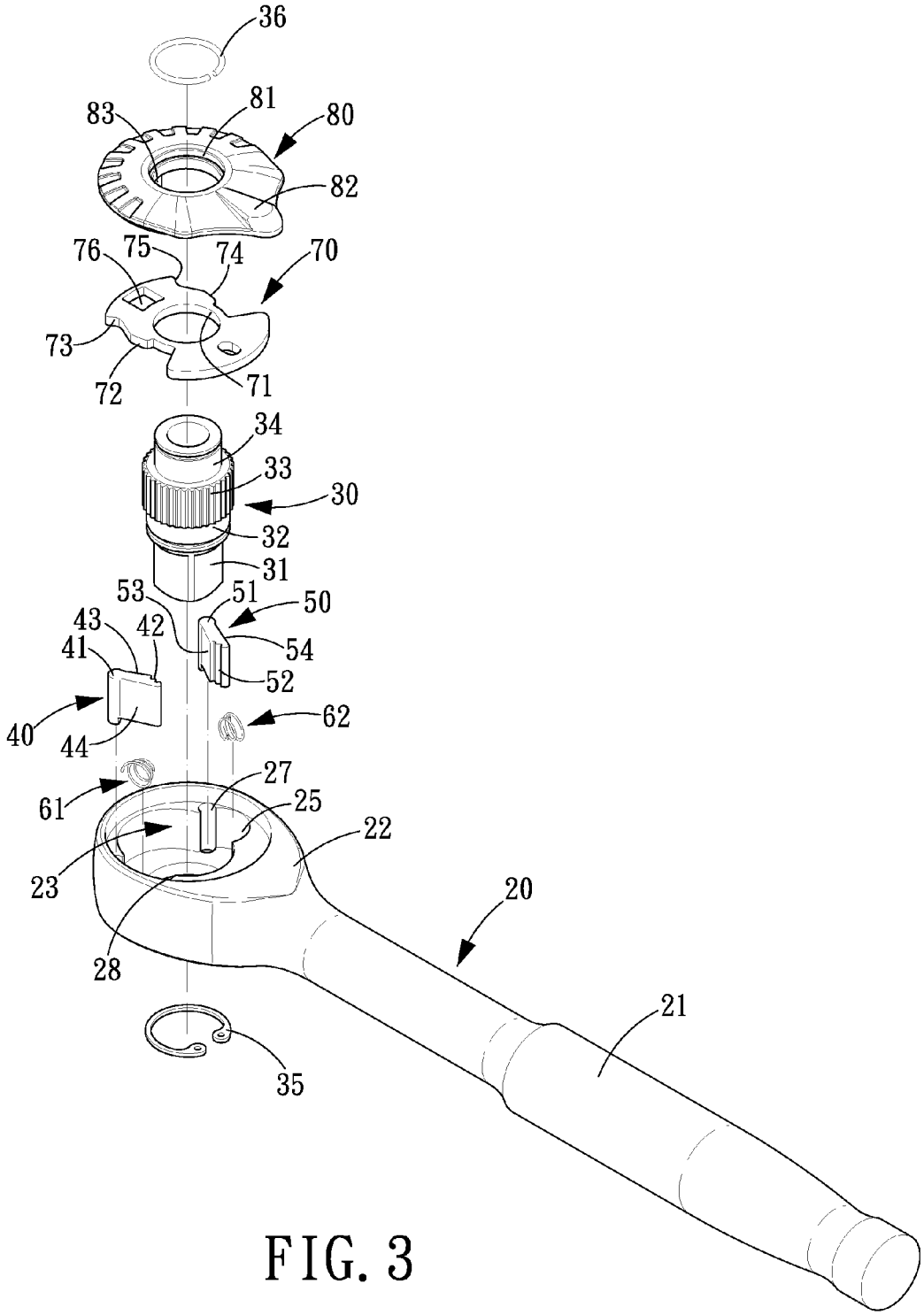
FIG. 3 is an exploded view of a reversing device for a ratchet wrench in accordance with a first embodiment of the present invention.
Figure 4:
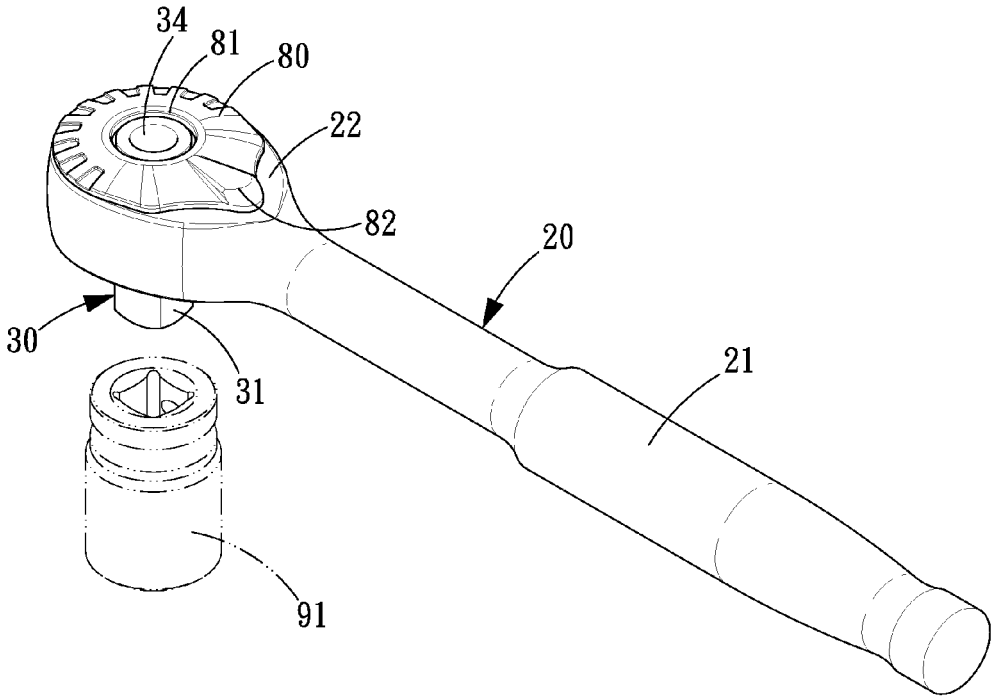
FIG. 4 is an assembly view of the reversing device for a ratchet wrench in accordance with the first embodiment of the present invention.
Figure 5:
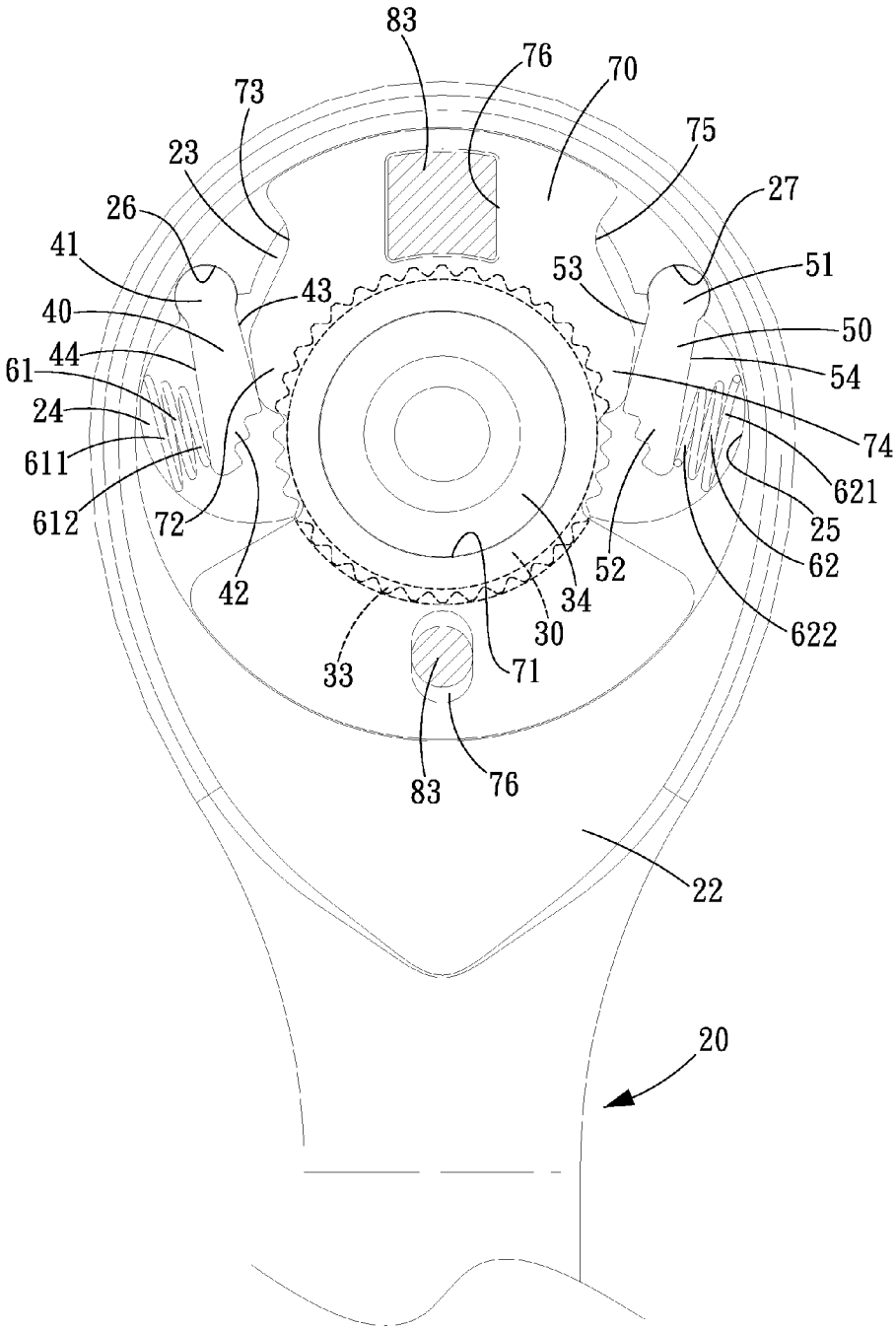
FIG. 5 is a partially cross sectional view of the reversing device for a ratchet wrench in accordance with the present invention, wherein the control member is located at the first position.

Referring to FIGS. 3-5, a reversing device for a ratchet wrench in accordance with the present invention comprises a body 20 of the ratchet wrench, a ratchet wheel 30, a left engaging member 40, a right engaging member 50, a left spring 61, a right spring 62, a control member 70, and a control cover 80.

The body 20 includes a handle portion 21, a head portion 22 connected to the handle portion 21, a receiving cavity 23 formed in the head portion 22, a left groove 24, a right groove 25, a left pivot groove 26, a right pivot groove 27 which are formed on the inner surface of the receiving cavity 23, and a hole 28 formed in the bottom of the receiving cavity 23.

Figure 10:
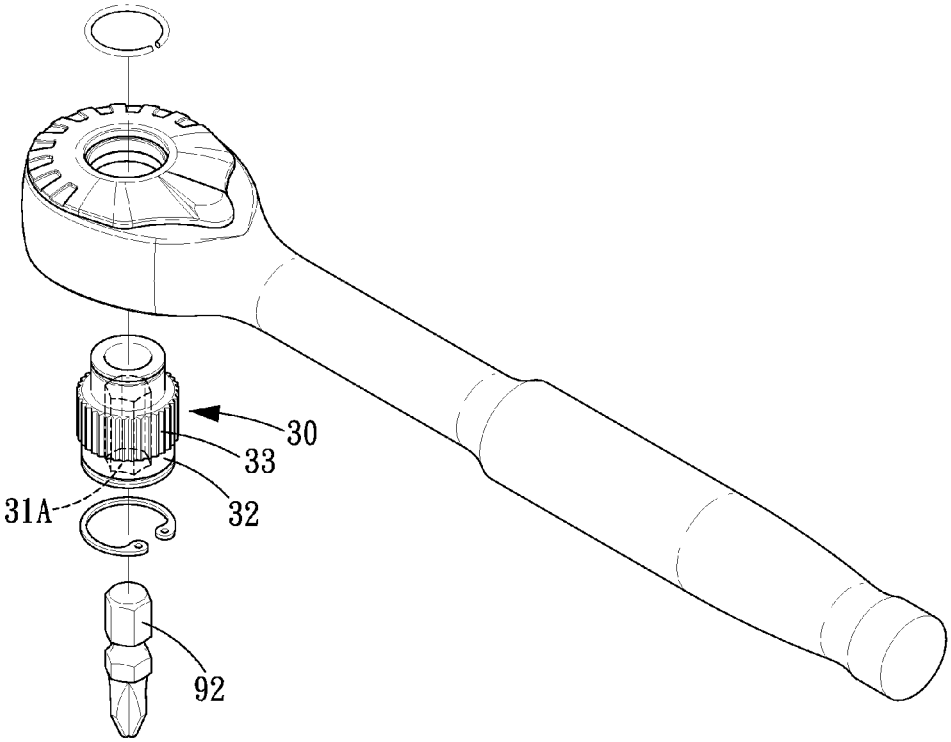
FIG. 10 is an exploded view of the reversing device for a ratchet wrench in accordance with the present invention, wherein the work portion is in the form a cavity.

The ratchet wheel 30 is pivotally disposed in the head portion 22 and includes a work portion 31, a first pivot portion 32 inserted in the hole 28, a ratchet portion 33 connected to the first pivot portion 32 and pivotally disposed in the receiving cavity 23, and a second pivot portion 34 connected to the ratchet portion 33. In this embodiment, the work portion 31 is a columnar structure connected to the first pivot portion 32 and exposed out of the receiving cavity 23 to engage with a socket 91. Or, as shown in FIG. 10, the work portion 31A can also be in the form of a cavity which is formed in the first pivot portion 32 and the ratchet portion 33 for insertion of a screwdriver head 92. Furthermore, a C-shaped retainer 35 is clasped around the first pivot portion 32 and located outside the hole 28 of the body 20 to restrict the ratchet wheel 30 within the receiving cavity 23.

The left engaging member 40 is pivotally disposed in the head portion 22 and includes a left pivot portion 41 pivotally disposed in the left pivot groove 26, a left toothed portion 42 to be engaged or not engaged with the ratchet portion 33, a left abutting surface 43 formed between the left pivot portion 41 and the left toothed portion 42 and located toward the ratchet portion 33, and a left push surface 44 formed between the left pivot portion 41 and the left toothed portion 42 and located toward the left groove 24.

The right engaging member 50 is pivotally disposed in the head portion 22 and includes a right pivot portion 51 pivotally disposed in the right pivot groove 27, a right toothed portion 52 to be engaged or not engaged with the ratchet portion 33, a right abutting surface 53 formed between the right pivot portion 51 and the right toothed portion 52 and located toward the ratchet portion 33, and a right push surface 54 formed between the right pivot portion 51 and the right toothed portion 52 and located toward the right groove 25.

The left spring 61 is disposed between the left engaging member 40 and the left groove 24 and includes a first left end 611 to be abutted against the left groove 24, and a second left end 612 which is pushed against the left push surface 44 to push the left toothed portion 42 to move toward the ratchet portion 33.

The right spring 62 is disposed between the right engaging member 50 and the right groove 25 and includes a first right end 621 to be abutted against the right groove 25, and a second right end 622 which is pushed against the right push surface 54 to push the right toothed portion 52 to move toward the ratchet portion 33.

The control member 70 is pivotally disposed in the head portion 22 and includes a first pivot hole 71 for insertion of the second pivot portion 34 of the ratchet wheel 30, a left protrusion 72 selectively to be or not to be pushed against the left abutting surface 43 of the left engaging member 40, a left concave portion 73 for accommodation of the left pivot portion 41 of the left engaging member 40, a right protrusion 74 selectively to be or not to be pushed against the right abutting surface 53 of the right engaging member 50, a right concave portion 75 for accommodation of the right pivot portion 51 of the right engaging member 50, and two inserting holes 76.

The control cover 80 is pivotally disposed in the head portion 22 to cover the receiving cavity 23 and includes a second pivot hole 81 for insertion of the second pivot portion 34 of the ratchet wheel 30, a control protrusion 82 to be turned by the user, and an inserting portion 83 inserted in the inserting holes 76 to push the control member 70 to rotate. In this embodiment, a C-shaped retainer 36 is clasped around the second pivot portion 34 and located outside the second pivot hole 81 of the control cover 80 to restrict the ratchet wheel 30 within the receiving cavity 23 and prevent the control member 70 and the control cover 80 from disengaging from the body 20 of the ratchet wrench.

Referring then to FIGS. 4 and 5, when the control cover 80 turns the control member 70 to a first position where the left and right protrusions 72, 74 of the control member 70 are pushed against the left and right abutting surfaces 43, 53 of the left and right engaging members 40, 50 to make the left and right toothed portions 42, 52 of the left and right engaging members 40, 50 disengage from the ratchet portion 33 of the ratchet wheel 30. At this moment, the ratchet wheel 30 within the receiving cavity 23 of the body 20 of the ratchet wrench is capable of idly rotating in both clockwise and counterclockwise directions, to inform the user that he ratchet wrench is in a non-working state.

Figure 6:
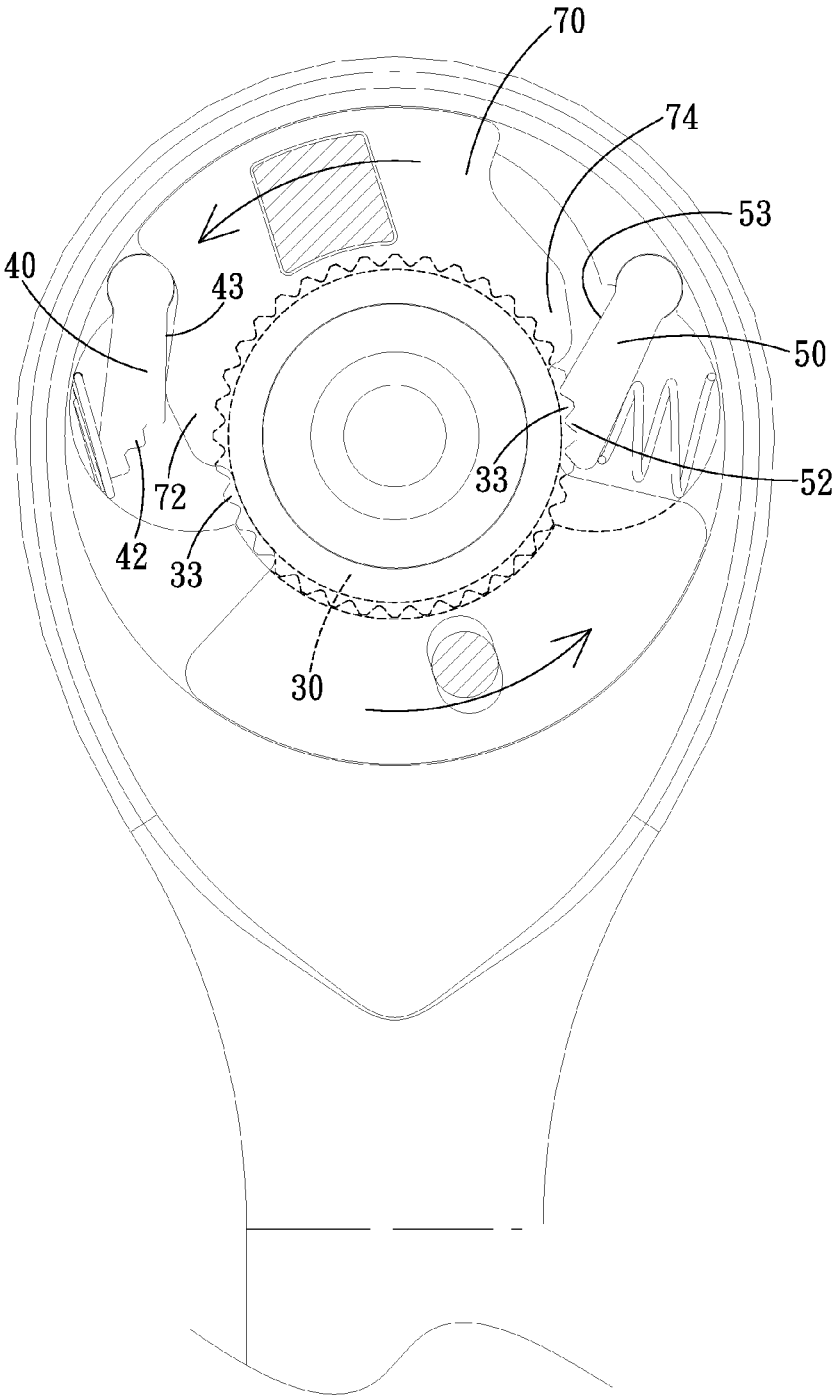
FIG. 6 is a partially cross sectional view of the reversing device for a ratchet wrench in accordance with the present invention, wherein the control member is located at the second position.

Referring then to FIGS. 4 and 6, when the control cover 80 turns the control member 70 to a second position (namely, to counterclockwise rotate an angle to set the ratchet wrench into an one-way torque status) where the left protrusion 72 of the control member 70 is pushed against the left abutting surface 43 of the left engaging member 40 to make the left toothed portion 42 disengage from the ratchet portion 33 of the ratchet wheel 30. The right protrusion 74 of the control member 70 is not pushed against the right abutting surface 53 of the right engaging member 50 to make the right toothed portion 52 of the right engaging member 50 engage with the ratchet portion 33 of the ratchet wheel 30. At this moment, the ratchet wheel 30 is stopped from rotating counterclockwise by the right toothed portion 52 of the right engaging member 50, namely, the right engaging member 50 is engaged with the ratchet wheel 30 to provide an one-way torque.

Figure 7:
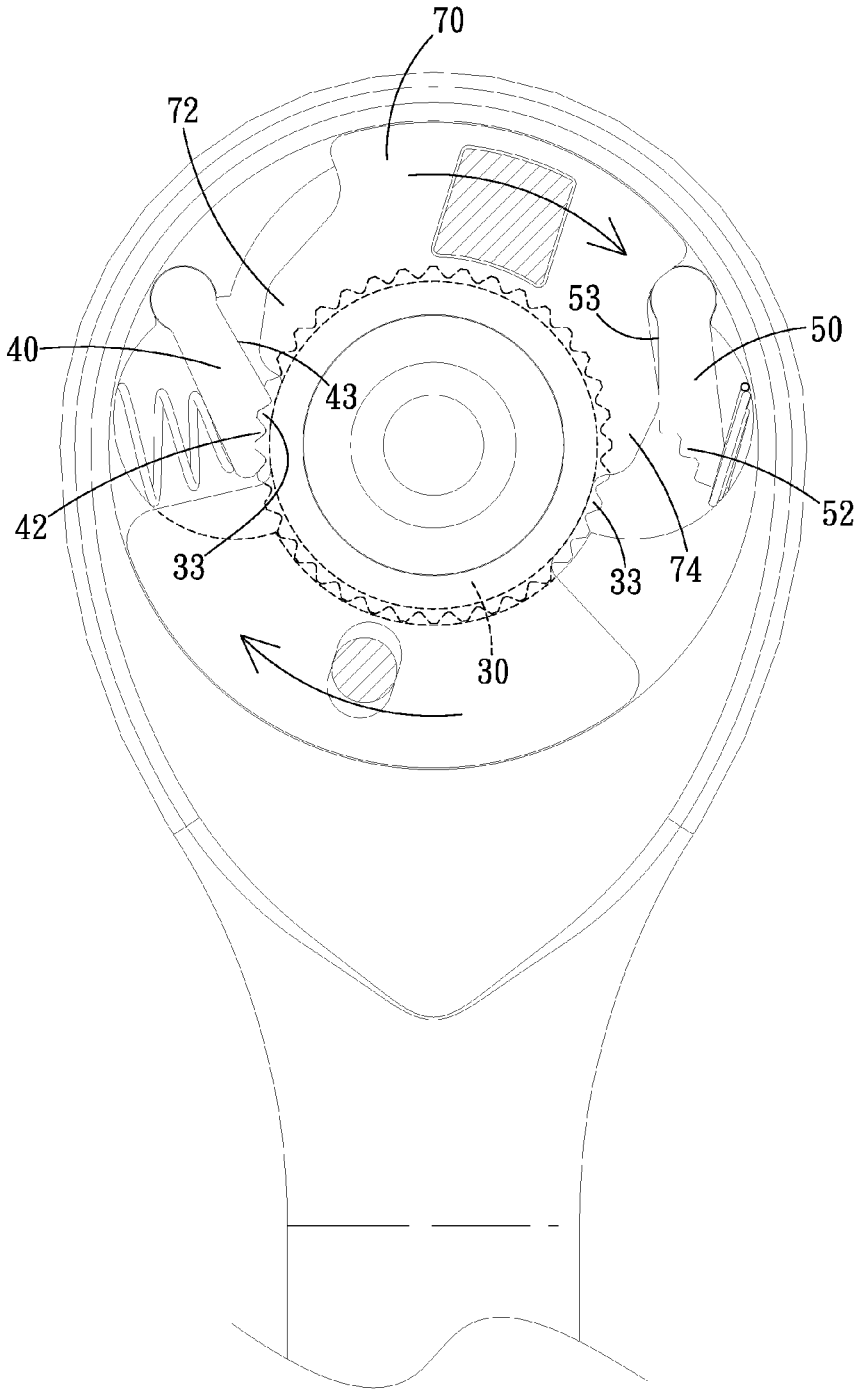
FIG. 7 is a partially cross sectional view of the reversing device for a ratchet wrench in accordance with the present invention, wherein the control member is located at the third position.

Referring then to FIGS. 4 and 7, when the control cover 80 turns the control member 70 to a third position (namely, clockwise rotate an angle to set the ratchet wrench into an one-way torque status) where the right protrusion 74 of the control member 70 is pushed against the right abutting surface 53 of the right engaging member 50 to make the right toothed portion 52 disengage from the ratchet portion 33 of the ratchet wheel 30, and the left protrusion 72 of the control member 70 is not pushed against the left abutting surface 43 of the left engaging member 40 to make the left toothed portion 42 of the left engaging member 40 engage with the ratchet portion 33 of the ratchet wheel 30. At this moment, the ratchet wheel 30 is stopped from rotating clockwise by the left toothed portion 42 of the left engaging member 40, namely, the left engaging member 40 is engaged with the ratchet wheel 30 to provide an one-way torque.

It is to be noted that, in the one-way torque status as shown in FIG. 6, the control member 70 is not in contact with the right engaging member 50 to make the right toothed portion 52 of the right engaging member 50 engage with the ratchet portion 33 of the ratchet wheel 30. In another one-way torque status as shown in FIG. 7, the control member 70 is not in contact with the left engaging member 40 to make the left toothed portion 42 of the left engaging member 40 engage with the ratchet portion 33 of the ratchet wheel 30. Hence, the problem that the left or right engaging member 40, 50, when subjected to a force, will push the control member 70 to reversely rotate and cause slippage, can be prevented.

Referring back to FIGS. 4 and 5 again, since the second pivot portion 34 of the ratchet wheel 30 is inserted both in the first pivot hole 71 of the control member 70 and the second pivot hole 81 of the control cover 80, the control member 70 and the control cover 80 all rotate about the second pivot portion 34 of the ratchet wheel 30, and accordingly the rotation is stable and smooth.

Figure 8:
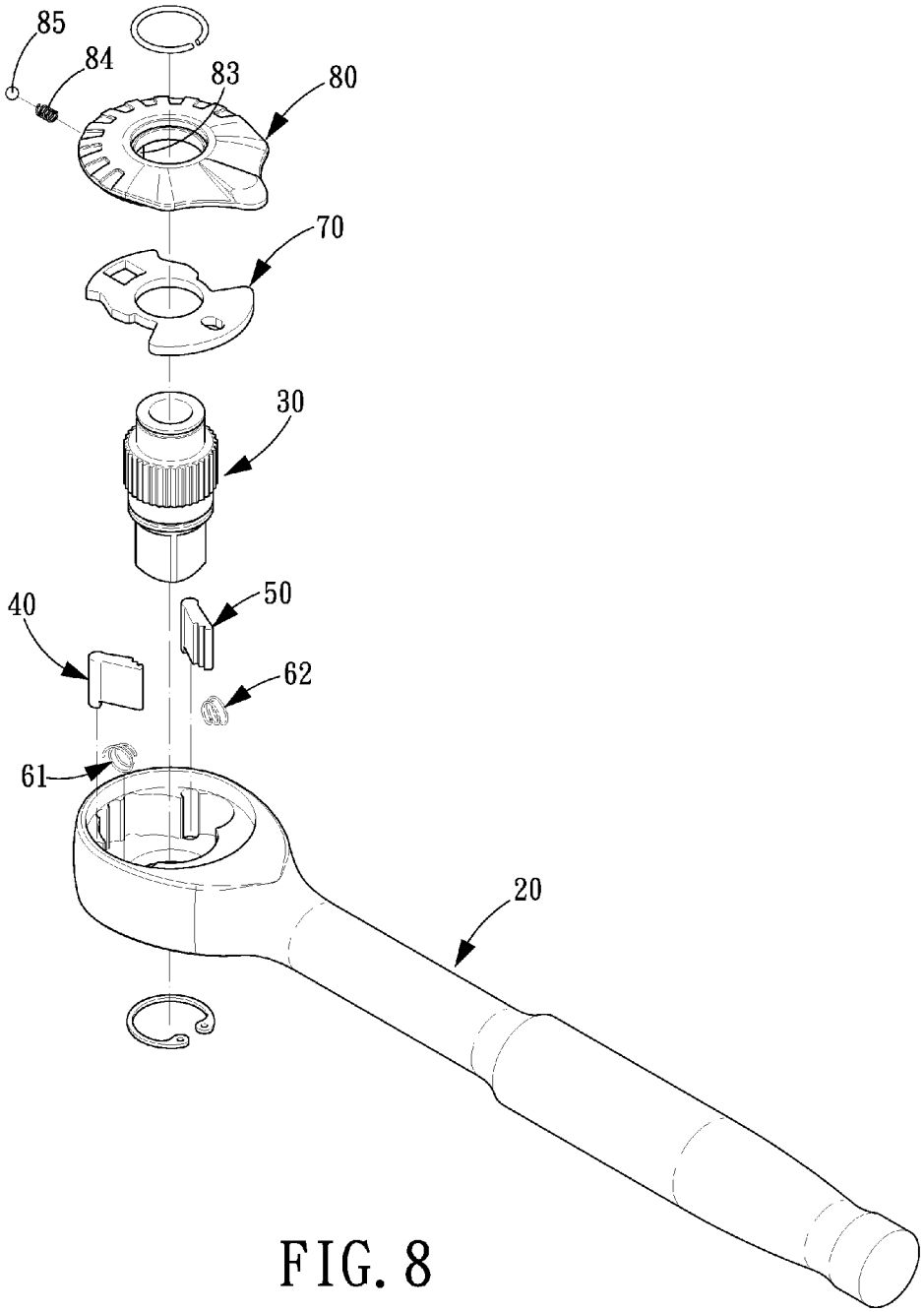
FIG. 8 is an exploded view of a reversing device for a ratchet wrench in accordance with a second embodiment of the present invention.
Figure 9:
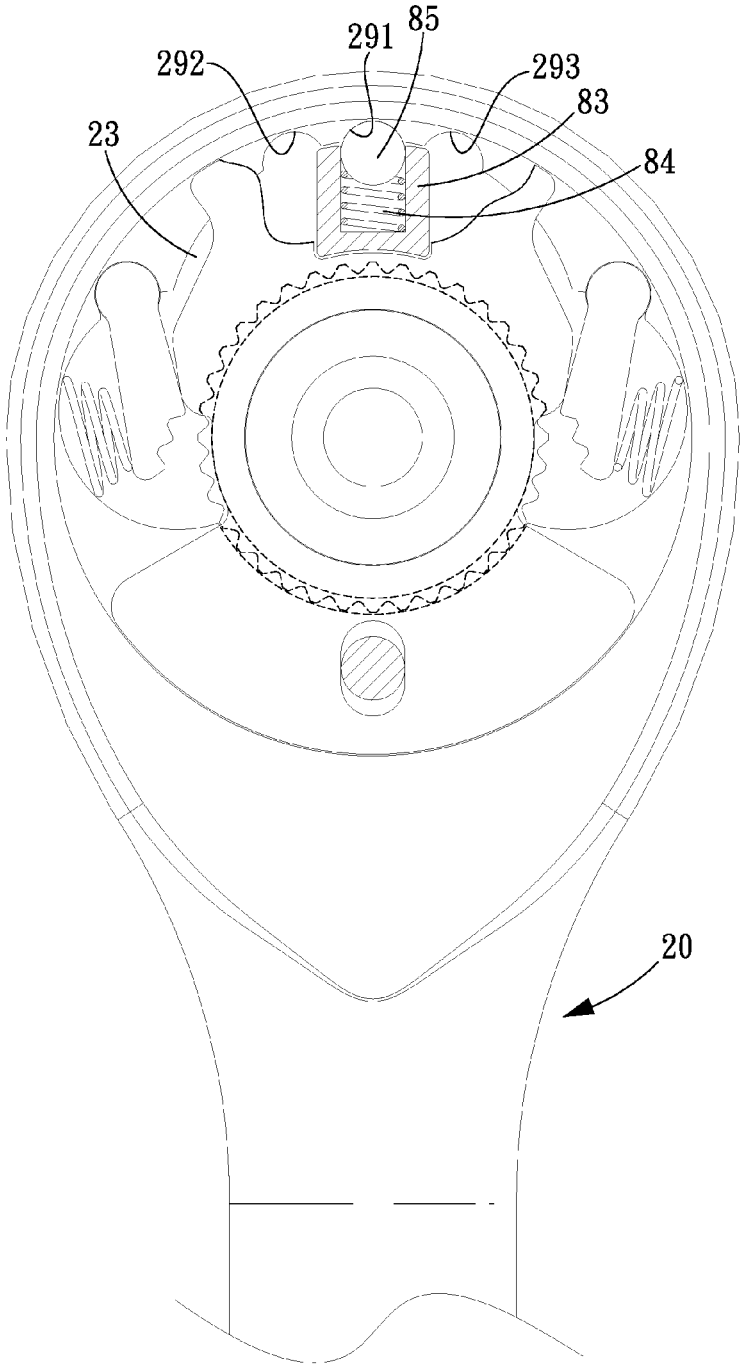
FIG. 9 is a partially cross sectional view of the reversing device for a ratchet wrench in accordance with the second embodiment of the present invention.

Referring finally to FIGS. 8 and 9, another embodiment of a reversing device for a ratchet wrench is similar to the previous embodiment, except that: on the inner surface of the receiving cavity 23 of the body 20 are additionally formed a first groove 291, a second groove 292, and a third groove 293. In the inserting portion 83 of the control cover 80 are disposed a compression spring 84, and a ball 85 which is pressed against the compression spring 84 and partially exposed out of the inserting portion 83. When the control cover 80 rotates the control member 70 to the first, second and third positions, the ball 85 will be engaged in the first, second and third grooves 291, 292, 293, respectively, to enable the control member 70 to be accurately and stably positioned in the desired position during the rotation of the control cover 80.

While we have shown and described various embodiments in accordance with the present invention, it is clear to those skilled in the art that further embodiments may be made without departing from the scope of the present invention.

What is claimed is:

1. A reversing device for a ratchet wrench, comprising:

a body of the ratchet wrench including a handle portion, a head portion connected to the handle portion, a receiving cavity formed in the head portion, a left groove, a right groove, a left pivot groove, a right pivot groove which are formed on an inner surface of the receiving cavity, and a hole formed in the bottom of the receiving cavity;

a ratchet wheel pivotally disposed in the head portion and including a work portion, a first pivot portion inserted in the hole, a ratchet portion connected to the first pivot portion and pivotally disposed in the receiving cavity, and a second pivot portion connected to the ratchet portion;

a left engaging member pivotally disposed in the head portion and including a left pivot portion pivotally disposed in the left pivot groove, a left toothed portion selectively engaged with the ratchet portion, a left abutting surface formed between the left pivot portion and the left toothed portion and located toward the ratchet portion, and a left push surface formed between the left pivot portion and the left toothed portion and located toward the left groove;

a right engaging member pivotally disposed in the head portion and including a right pivot portion pivotally disposed in the right pivot groove, a right toothed portion selectively engaged with the ratchet portion, a right abutting surface formed between the right pivot portion and the right toothed portion and located toward the ratchet portion, and a right push surface formed between the right pivot portion and the right toothed portion and located toward the right groove;

a left spring disposed between the left engaging member and the left groove and including a first left end to be abutted against the left groove, and a second left end which is pushed against the left push surface to push the left toothed portion to move toward the ratchet portion;

a right spring disposed between the right engaging member and the right groove and including a first right end to be abutted against the right groove, and a second right end which is pushed against the right push surface to push the right toothed portion to move toward the ratchet portion;

a control member pivotally disposed in the head portion and including a first pivot hole for insertion of the second pivot portion of the ratchet wheel, a left protrusion selectively pushed against the left abutting surface of the left engaging member, a left concave portion for accommodation of the left pivot portion of the left engaging member, a right protrusion selectively pushed against the right abutting surface of the right engaging member, a right concave portion for accommodation of the right pivot portion of the right engaging member; and a control cover pivotally disposed in the head portion to cover the receiving cavity and including a second pivot hole for insertion of the second pivot portion, and an inserting portion inserted in the control member to push the control member to rotate;

when the control cover turns the control member to a first position, the left and right protrusions of the control member are pushed against the left and right abutting surfaces of the left and right engaging members to make the left and right toothed portions of the left and right engaging members disengage from the ratchet portion of the ratchet wheel; when the control cover turns the control member to a second position, the left protrusion of the control member is pushed against the left abutting surface of the left engaging member to make the left toothed portion disengage from the ratchet portion of the ratchet wheel, the right protrusion of the control member is not pushed against the right abutting surface of the right engaging member to make the right toothed portion of the right engaging member engage with the ratchet portion of the ratchet wheel; when the control cover turns the control member to a third position, where the right protrusion of the control member is pushed against the right abutting surface of the right engaging member to make the right toothed portion disengage from the ratchet portion of the ratchet wheel, and the left protrusion of the control member is not pushed against the left abutting surface of the left engaging member to make the left toothed portion of the left engaging member engage with the ratchet portion of the ratchet wheel.

2. The reversing device for a ratchet wrench as claimed in claim 1, wherein the work portion is a columnar structure connected to the first pivot portion and exposed out of the receiving cavity.

3. The reversing device for a ratchet wrench as claimed in claim 1, wherein the work portion is a cavity formed in the first pivot portion and the ratchet portion.

4. The reversing device for a ratchet wrench as claimed in claim 1, wherein the control member is formed with an inserting hole for insertion of the inserting portion of the control cover.

5. The reversing device for a ratchet wrench as claimed in claim 1, wherein the control cover includes a control protrusion to be turned by a user.

6. The reversing device for a ratchet wrench as claimed in claim 1, wherein a first groove, a second groove, and a third groove are formed on the inner surface of the receiving cavity of the body, and in the inserting portion of the control cover are disposed a compression spring, and a ball which is pressed against the compression spring and partially exposed out of the inserting portion, when the control cover rotates the control member to the first, second and third positions, the ball will be engaged in the first, second and third grooves, respectively.

* * * * *